United States Patent [19]

Hackett et al.

[11] 4,203,198

[45] May 20, 1980

[54] METHOD OF CONSTRUCTION OF ELECTRICAL HEATING PANELS

[75] Inventors: Barrie H. Hackett, Gray; Rudolph W. Wissley, Portland, both of Me.

[73] Assignee: International Telephone and Telegraph Corporation, New York, N.Y.

[21] Appl. No.: 965,754

[22] Filed: Dec. 4, 1978

[51] Int. Cl.[2] ..... H05B 3/36

[52] U.S. Cl. ..... 29/611; 29/613; 29/619; 219/528

[58] Field of Search ..... 29/611, 612, 613, 621, 29/624, 628; 219/528; 338/293, 314, 254

[56] References Cited

U.S. PATENT DOCUMENTS

| | | | |
|---|---|---|---|
| 2,777,930 | 1/1957 | Nathanson | 338/254 |
| 3,417,229 | 12/1968 | Shomphe | 219/543 |
| 3,495,328 | 2/1970 | Ziver | 29/611 |
| 3,584,198 | 6/1971 | Doi | 219/528 |
| 3,774,299 | 11/1973 | Sato | 29/611 |
| 3,824,521 | 7/1974 | Horii | 338/254 |

*Primary Examiner*—Daniel C. Crane
*Assistant Examiner*—Gene P. Crosby
*Attorney, Agent, or Firm*—John T. O'Halloran; Robert A. Walsh

[57] ABSTRACT

A heating panel array is of a "sandwich" configuration and employs a serpentine resistive array fabricated from a metal foil and disposed between two sheets of fiber glass cloth, all of which are secured together by a binder having stable properties in the presence of heat generated when said array is energized. The binder contains colloidal silica spheres of submicron diameter. Methods for fabricating the panel are described which enable fabrication of a multiplicity of panels using selective etching and silk screening techniques. The fabrication process assures the absence of impurities in the heater panel construction and in conjunction with the binder enable the panel to operate without smoking and aromatic problems.

12 Claims, 4 Drawing Figures

METHOD OF CONSTRUCTION OF ELECTRICAL HEATING PANELS

BACKGROUND OF THE INVENTION

This invention relates to a relatively flat flexible electrical heating panel and methods of fabricating such panels.

The prior art contains a plethora of patents which relate to electrical heating panels which essentially incorporate flexible resistive elements mounted on suitable backings. Such panels have widespread use as in blankets, heating pads, hot plates, or in any application where heat is desired by the use of a relatively thin and compact configuration. The panels function to provide heat by the application of a suitable current to the panel. The resistors which usually form a flat array produce heat due to the power dissipated in the resistive array when subjected to an electrical current.

As can be ascertained, there is a need to fabricate and produce such a panel in any desired size as economically and efficiently as possible. The panels should also provide a sufficient amount of heat without producing smoke or odor when they are subjected to an operating current. These properties are desirable as should be apparent. Many prior art panels incorporate bonding elements and resistive elements which undesirably produce odors and smoke during operation. These objectional characteristics are provided, even though the panel may be operating satisfactorily. Hence, as one can ascertain, the generation of both or either of the above noted conditions will result in many consumer and customer complaints in using and employing the panel.

As indicated above, many uses and various structures have such panels and are known in the prior art and many patents exist which show particular types of configurations and formats.

Patents such as U.S. Pat. No. 3,774,299 entitled "Method for Production of Panel Heater" issued on Nov. 27, 1973 describes a technique of producing a panel heater employing the steps of mixing a carbon fiber with natural or synthetic fibers. The mixture is formed on a sheet of base material and the sheet is then heated to expel volatile matter. Essentially, the panel is of a composite configuration which is typical of many prior art panels.

U.S. Pat. No. 3,417,229 issued on Dec. 17, 1968 shows a flexible panel employing resistive strips as heating elements. The strips are encapsulated within a flame retardant flexible material.

Other patents such as U.S. Pat. Nos. 3,423,574, 3,546,432, 3,591,753, 3,721,250, 3,749,886, 3,766,644, 3,813,520, 3,814,898, 3,875,373, 3,909,591, 3,987,717, 4,016,654, 4,034,206, 4,052,588 and many other patents too numerous to cite, show various alternate constructions of flexible heating panels and particularly depict numerous and various applications in which such panels are directed for use.

Accordingly, it is a primary object of the present invention to provide a panel which provides smokeless and odorless operation and based on its construction and fabrication enables utilization in a variety of widespread and diverse applications. The particular panel and the techniques for producing the same assure reliable operation, while avoiding many of the difficulties inherent in the prior art devices.

DESCRIPTION OF THE PREFERRED EMBODIMENT

A composite flexible heating panel comprises a first bottom sheet of an insulating material fabricated from a fiber glass cloth which has a mesh like pattern. A serpentine metallic foil resistive array is positioned on the first sheet and a top sheet of the same material as the first sheet is positioned to cover the array. The composite sandwich configuration is secured together by means of a binder which includes colloidal silica spheres. The panel is fabricated employing a silk screening technique wherein a resistive array pattern is impressed on a given surface of a thin metallic foil. The foil is curtain coated on one side by a polymer compound and is then etched to remove all the foil not within the pattern to form a resistive array on the polymer sheet. The first sheet of fiber glass cloth is placed over the opposite surface of the foil. The polymer sheet is then stripped from the foil by securing the foil within a magnetic field and then stripping the polymer coating therefrom. A second sheet of fiber glass is then placed on the stripped surface and the two sheets are bound together and to the metal foil by the application of a binder which includes colloidal silica spheres to thus form the above noted composite heating panel structure.

BRIEF DESCRIPTION OF THE FIGURES

Above-mentioned and other features and objects of this invention will become more apparent by reference to the following description taken in conjunction with the accompanying drawings, in which.

DETAILED DESCRIPTION OF THE INVENTION

Figure 1:
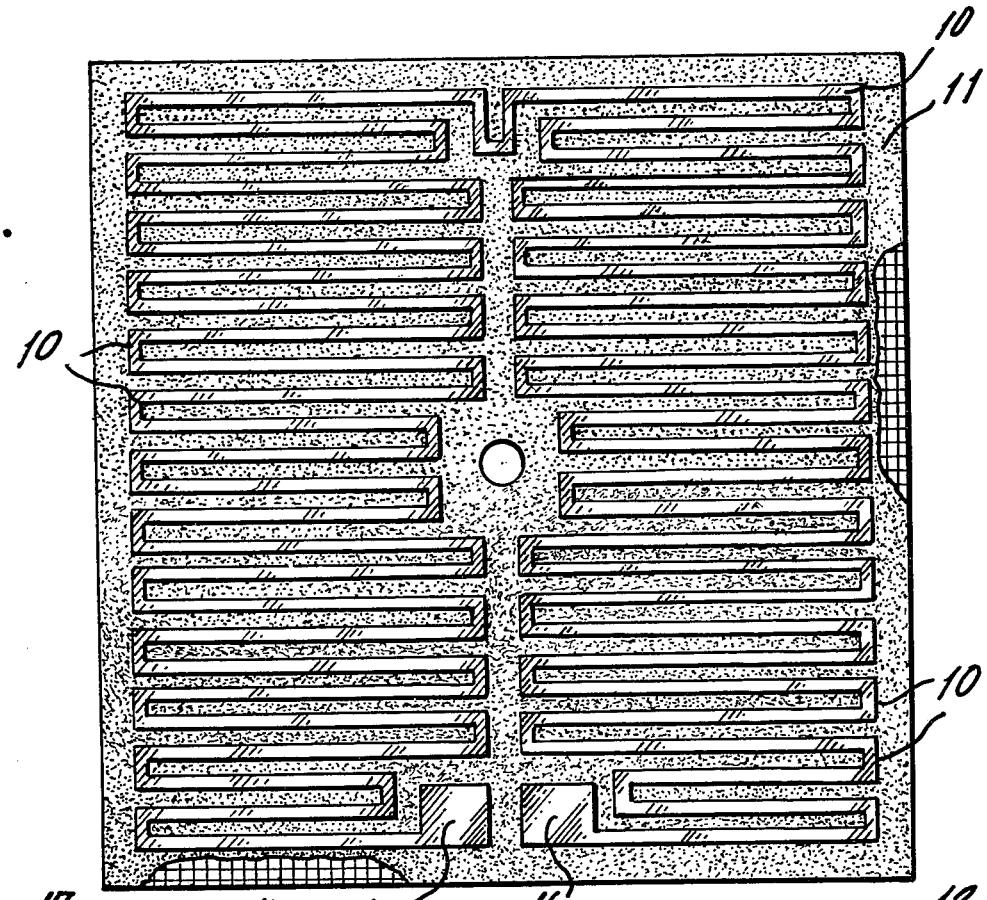
FIG. 1 is a top view showing a foil resistance pattern on a bottom sheet.

Referring to FIG. 1, there is shown a typical format of a resistive array 10 positioned on a surface of a support mesh 11. The mesh, as will be explained, is a fiberglass cloth material which possesses a linear weave pattern and is applied on a top and bottom surface of the resistor array 10. The cloth is saturated with a mechanical binding agent to be described to thus form a composite heating panel array as shown in cross-section in FIG. 2.

The panel consists of a bottom cloth 11 secured to the resistive array 10 and a top cloth 12 of the same configuration as the bottom cloth 11 and also secured to both the resistive array panel 10 and the bottom cloth 11 by means of a binding agent.

As indicated and shown in FIG. 1, for example, the top and bottom cloth materials are fabricated from a fiberglass yarn which is weaved into a linear pattern and applied as top and bottom backing members 11 and 12. Disposed between the backing members 11 and 12 is the resistive array 10. Essentially, the array 10 is a zigzag or serpentine configuration consisting of continuous loops of a metallic foil such as stainless steel, to form the array 10 as shown of a relatively large length and surface area, while possessing an extremely thin cross-section to thus acheive a large resistance in a relatively small area.

Figure 2:
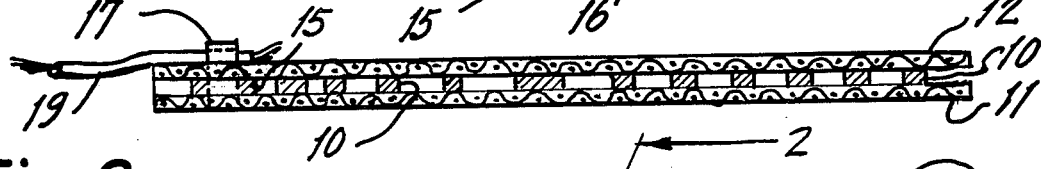
FIG. 2 is a side cross-sectional view of a heating panel according to this invention.

Shown located at the bottom of the array 10 are two enlarged terminal areas 15 and 16. These areas, as will be explained, are used to staple or otherwise secure leads to the array for application thereto of a suitable source of potential. As shown in FIG. 2, the leads are secured to the terminal areas 15 and 16 by means of staples as 17; which staples are inserted through the top cloth layer 12.

Figure 3:
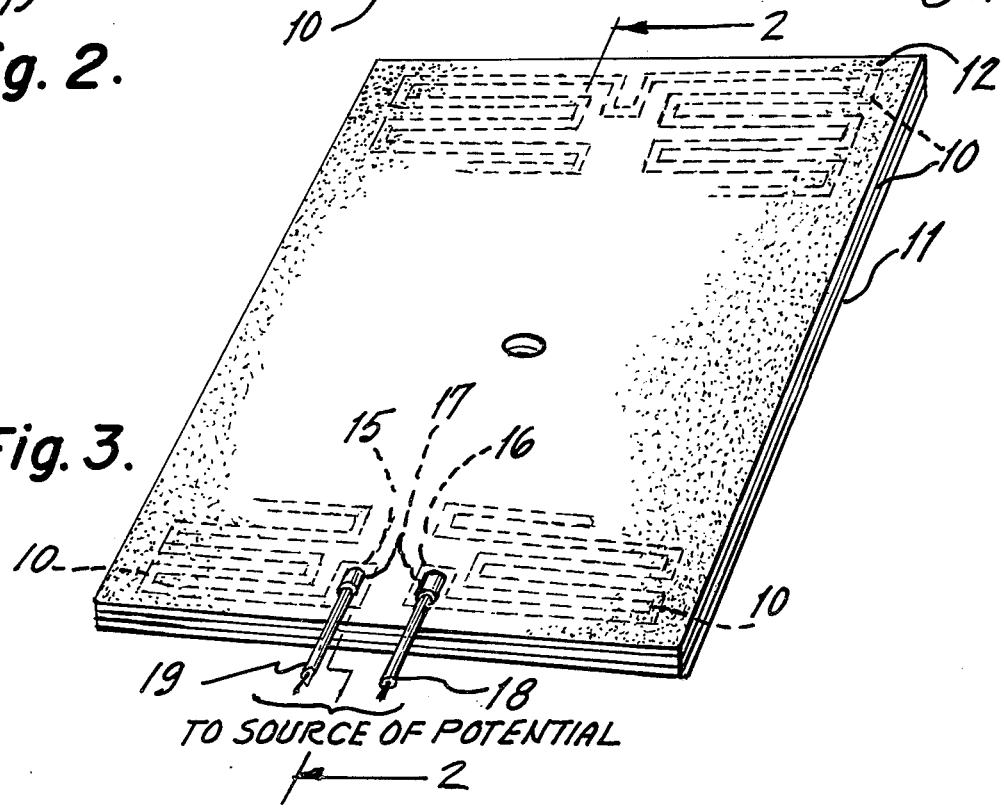
FIG. 3 is a perspective view of a heating panel according to this invention.

FIG. 3 shows a perspective view of the completed assembly which incorporates leads 18 and 19 respectively coupled to terminal areas 15 and 16 via the staples or other suitable fastening elements 17.

As will be explained, during the fabrication process, the resistive array 10 is first fabricated by means of a silk screening technique followed by an etching process. The array is then positioned and secured to a fiberglass sheet 11 and thence a sheet such as 12 is positioned over the array 10 and the sheet 11. A bonding agent is employed which assures that the composite configuration as shown in FIG. 2 is firmly secured together to thereby practically form an integral assembly.

Accordingly, based on the techniques of fabricating the heating panel, one obtains a final construction as shown in FIG. 3 wherein each component such as 10, 11 and 12 are intimately secured one to the other to provide an extremely compact, thin and flexible panel arrangement, which based on the nature of the mechanical binder and upon fabrication of the panel, permits smokeless and odorless operation in various applications and environments.

Figure 4:
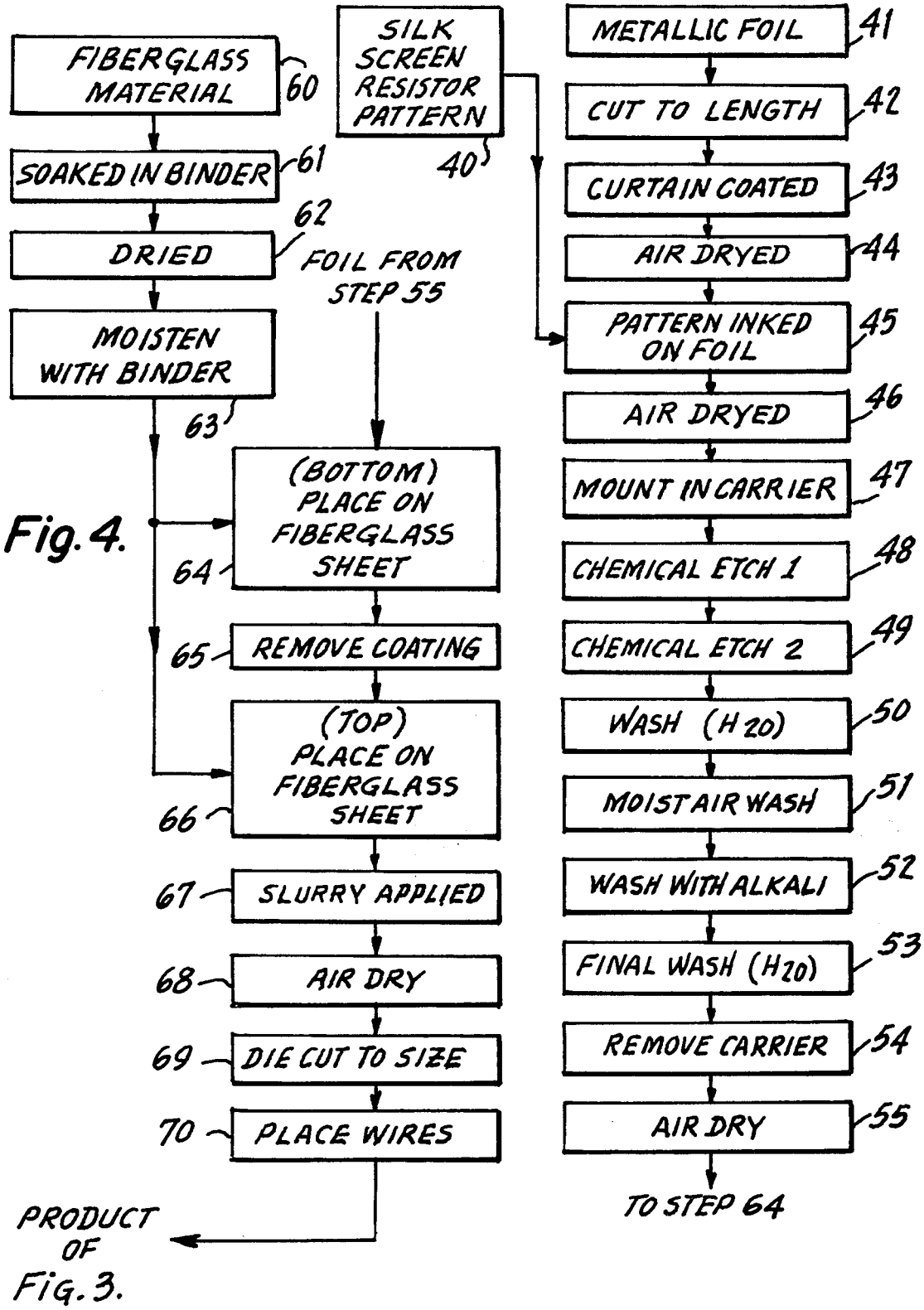
FIG. 4 is a diagrammatic view showing the various steps implemented in fabricating a heating panel according to this invention.

Referring to FIG. 4, there is shown a flow chart depicting the method of fabricating the heating panel structure indicated in FIGS. 1, 2 and 3.

As seen in FIG. 1, the resistive array or pattern 10 is of a relatively conventional configuration. A pattern is calculated based on the heating requirements of the final panel. The resistive pattern is formulated according to the requirements of a customer. The final pattern, as will be explained, is fabricated from a metal foil such as stainless steel. The total area accommodated by the pattern including the thickness of the foil determines the final resistance of the total array. Metal foil thicknesses may vary between 0.0005" and 0.002" depending upon the heat element resistance requirement. In most applications, a thickness of between 0.001" and 0.002" is preferred.

The resistor pattern or configuration as shown in FIG. 1 is formulated and drawn to scale. This pattern is then impressed by photographic techniques upon a silk screen. Essentially, the art of impressing a resistor pattern upon a silk screen is well known in the art. Silk screening or screen printing techniques are extensively used in the production and development of integrated circuits and particularly in thick film microcircuit technology.

The technique of impressing a resistor pattern such as that shown in FIG. 1 upon a silk screen is well known and reference is had to a textbook entitled "Thick Film Hybrid Microcircuit Technology" published by John Wiley & Sons (1972) by Donald W. Hamer et al. Chapter 5 in particular is entitled "Screen Printing" and describes many suitable techniques.

As shown in FIG. 4, the resistor pattern is emplaced on a silk screen as shown in Step 40. Once the resistor pattern of the proper size and dimensions is formulated as per Step 40, a metallic foil of a suitable thickness as indicated above, is unrolled and cut to length as depicted in Steps 41 and 42.

The metallic foil is then curtain coated on one side in Step 43. Basically, the term "curtain coated" is known in the art and essentially the metallic foil which is cut to a desired length is treated on one side with a coating similar to materials used to protect and preserve delicate metal surfaces of machinery and other equipment. These coatings have a polymer or rubber base and such materials are available and formulated by a large number of suppliers. The materials can be treated to increase or decrease the adhesion to the metal foil. The curtain coating is thus impressed upon one side of the metal foil to enable it to withstand the etching process as to form a reliable and strong backing which will protect the resistor pattern which is to be fabricated. The backing material is employed for handling the foil during the steps of the process to be described, but it is removed and is non-existent in the final product. As indicated, there are many suitable types of coatings which can be employed to thus coat one side of the foil.

The foil as coated is then allowed to dry as shown in Step 44. This can be accomplished by ordinary air drying to assure that the coating material adheres to the foil and that it has been suitably cured for further processing.

The curtain coated foil is then placed in a screen printer as shown in Step 45. The screen printer basically serves to force a fluid ink through the silk screen to thereby produce the resistive pattern on the uncoated foil surface, wherein the resistor pattern is completely delineated by the use of the ink. Inks employed in such processes are also well known in the art and the above noted text provides many examples of suitable inks which are used in the integrated circuit technology. There are many companies which supply screen printers or ink applicators which can be used to implement the process depicted by Step 45.

The foil which has the pattern inked on the surface thereof is now air dryed as shown in Step 46 and mounted in a suitable carrier as shown in Step 47. The carrier is a frame which basically serves to retain the inktreated foil to enable the foil with the resistor pattern impressed thereon, to be placed in a chemical etch apparatus.

The foil plus the carrier is now subjected to an acid or chemical milling process as depicted in Step 48. Essentially, the acid etch is provided by means of a chemical etching machine such as a device manufactured by Advance Systems, Inc. of Phoenix, Az. The machine employs ferric chloride as an etchant. The etch serves to selectively remove the material according to the resistor pattern impressed on the material by means of the ink. The etch will not attack the ink or that metal which is coated by the ink, but in fact, etches away all the excess metal. The etch will also not attack or effect the curtain coating. The foil may be subjected to the etching process one or more times until the resistor pattern is left upon the curtain coating. These steps are referenced by numerals 48 and 49 in the flow chart.

The etched pattern which is now on the curtain coated material is then washed with water in Step 50 and is then washed again with moist air as shown in Step 51. The treated pattern is then washed with an alkali such as sodium hydroxide (NaOH).

Basically, the sodium hydroxide is used as an ink remover and also serves to completely neutralize the acid etch employed in the etching steps 48 and 49. The foil pattern and the coating may be rinsed with alkali one or more times to assure the complete removal of the acid which was employed in the etch and ink.

The structure is then washed again in Step 53 with water to remove the alkali plus any traces of ink or other impurities. In Step 54, the carrier is removed and the etched resistor pattern on the curtain backing is then dried in Step 55.

Hence, at this point in the process, one now has the resistor pattern as shown in FIG. 1 which is secured to the material formed as a backing in Step 43. The next step in the process is to emplace the fiber glass cloths 11 and 12 to finally complete the structure.

Referring to Step 60, fiber glass material is cut to a predetermined size depending on the dimensions of the array and so on. The fiber glass material is a standard style 16–59 weave which is purchased as greige goods from J. P. Stevens Corp. Fiber glass cloth of this type is available in the same construction from many other companies, as well.

In any event, the cloth employed should contain a minimum amount of organic sizing to maintain the fiber integrity during the weaving process. Due to the fact that the cloth is to be used in a heater assembly, a low amount of sizing should be employed, as the sizing is usually a soluble starch.

The fiber glass cloth is then soaked in a binder or a slurry in Step 61. This is used to stabilize the cloth prior to further processing. As will be explained, the binder used to stabilize the cloth is of the same type of binder which is used to secure the top and bottom cloths to each other and therefore, to the metallic resistor array which is interposed therebetween.

Basically, the binding material is an aqueous colloidal dispersion of distinct and uniform submicron silica spheres ($SiO_2$). Because of their colloidal nature, the particles present a large surface area. The particles are chemically inert and relatively stable in the presence of large amounts of heat. The silica spheres are dispersed in an alkaline solution which reacts with the silica surfaces to produce a negative charge. This negative charge causes the particles to repel one another and therefore provide a uniform and stable solution.

Suppliers of such colloidal silica compounds are the Dupont DeNemours Co. and the Nalco Chemical Co. The material sold by Dupont is designated by the trade name "Ludox" and particular grades of specific application which are used as a binder are designated as HS-30% and HS-40%. The percentages of the term HS represent the silica solid content. The material available from Nalco is sold under the trade name "Nalcoag" in the form of grade 10–30 and 10–50 and Nalco 2327, with the 30 and 50 representing the percentage of silica. The compounds can be further dilluted with water for handling purposes and when dried, have no detectable crystallinity. Compounds containing colloidal silica have been used as high temperature binders for metal casting, for insulations and in the fabrication of refractory cements and so on.

Thus, in Step 61, the fiber glass cloth is soaked in a binder which contains the silica compound. The compound is added to common water and a given amount of ground mica of 160 mesh is added to produce a workable slurry. The slurry is not critical but one gallon of 30% solid colloidal silica binder is added to about ten pounds of mica powder to form an appropriate slurry. The mica powder is employed as a filler to thicken and reinforce the fiber glass sheet. This slurry is used in Step 67.

The treated fiber glass sheet is then dried in Step 62. It is then again moistened with a small amount of binder and the foil pattern placed on top as shown in Steps 63 and 64. The composite structure available in Step 64 is now a fiber glass sheet which is emplaced on top of the exposed foil pattern; which foil pattern is emplaced on top of the curtain coating.

In Step 65, the coating is removed. Essentially, the fiber glass cloth and the foil pattern is placed on a magnetic table or a sheet of magnetic material. The metal is thus firmly secured as is the cloth by the magnetic field and the coating is then peeled or stripped off.

A second or top fiber glass cloth is now placed on the peeled surface of the resistive pattern as in Step 66. The unit now consists of the top cloth and the bottom cloth having disposed therebetween, the resistor pattern or array. The entire array is now uniformly coated with the above described slurry as in Step 67. The binder thus seeps through the top and bottom cloths and completely intermeshes and thus secures one cloth to the other having the resistor pattern located therebetween. The mica particles serve to provide further strength to the composite structure.

The composite structure is then air dryed to remove residual water and other impurities as in Step 68. The composite structure can then be cut to a desired size as the above process has been described for the fabrication of a single resistive array. However, it is understood that in actual practice, one silk screens a plurality of resistive arrays on a single sheet of metal foil and the foil is then treated exactly as described above. In order to accommodate mass production techniques, in actual practice six or more arrays are silk screened on a single foil sheet and hence, in so doing one would then cut each array to size as depicted in Step 69 to thereby formulate six complete units.

The units are then led to a wire emplacement location where wires are stapled to the terminal areas as 15 and 16 associated with each array.

Thus, at the completion of the wire attaching Step 70, one now has a completed product as depicted in FIG. 3.

In summation, there has been provided an electrical heat panel which is flexible and useful in a wide variety of applications. The panel essentially consists of a metallic foil array which is disposed between two sheets of fiber glass mesh material. The entire structure is secured together by means of a silica binder; which binder is relatively inert and resistant to heat generated during the operation of the heater by the application of a voltage to the terminals. The techniques described enable one to provide various sized heater configurations according to customer requirements with a minimum of difficulty, while assuring the reliable and repeated operation.

As one can ascertain, the method of fabricating the panel which is depicted in FIG. 4 provides a series of steps wherein the metal foil is continuously washed and dried to remove all deleterious substances prior to insertion of the metal foil between the fiber glass sheets. These steps in the process assure that the final product is relatively free of substances which would cause excess odors when the panel is heated and which would further tend to produce smoke or other unpleasant effects. The operation is enhanced by means of the binder which, as indicated, is stable during the generation of heat and hence, the binder also aids in providing a product which prevents smoking and aromatic problems.

I claim:

1. The method of making an electricl heating panel, comprising the steps of:

silk screening at least one resistive array pattern on a given surface of a thin metallic foil, curtain coating the other surface of said foil with a polymer compound, etching said screened array to remove all foil not within said pattern to form a resistive foil array, positioning a first sheet of fiber glass cloth over said given surface of said array to form a composite structure, placing said structure in a magnetic field while stripping said polymer coating from said array, placing a second sheet of fiber glass on said other surface which contained said polymer coating, binding said array between said first and second sheets by applying a binder including colloidal silica spheres, to form a composite heating panel structure.

2. The method according to claim 1 further including the step of stapling leads to said array for application thereto of a source of potential.

3. The method according to claim 1 wherein said binder includes mica particles.

4. The method according to claim 1 wherein the step of etching includes applying a chemical to said screened array, which chemical selectively etches said foil not contained within said pattern.

5. The method according to claim 4 wherein said chemical is a ferric chloride.

6. The method according to claim 1 further comprising the step of washing said etched array with an alkali prior to the step of positioning said first sheet of fiber glass cloth.

7. The method according to claim 6 wherein said alkali is sodium hydroxide.

8. The method according to claim 6 further comprising the step of washing said array with water after washing with said alkali and prior to the step of positioning said first sheet of fiber glass cloth.

9. The method according to claim 1 further comprising the step of soaking said first fiber glass sheet in a binder prior to positioning the same over said array.

10. The method according to claim 9 wherein said binder comprises at least thirty percent by weight of a colloidal silica.

11. The method according to claim 1 wherein a plurality of resistive array patterns are silk screened on said foil.

12. The method according to claim 11 further including the step of: die cutting said composite panel structure to form separate units, each including a separate one of said plurality of resistive array patterns.

* * * * *